US009501015B2

(12) United States Patent
Kakishima et al.

(10) Patent No.: US 9,501,015 B2
(45) Date of Patent: Nov. 22, 2016

(54) IMAGE FORMING APPARATUS UTILIZING FLAT PIGMENT

(71) Applicant: FUJI XEROX CO., LTD., Tokyo (JP)

(72) Inventors: Aya Kakishima, Kanagawa (JP); Miho Ikeda, Kanagawa (JP); Koichiro Yuasa, Kanagawa (JP); Yasumitsu Harashima, Kanagawa (JP); Toko Hara, Kanagawa (JP); Yoshihiro Hayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/593,402

(22) Filed: Jan. 9, 2015

(65) Prior Publication Data

US 2016/0011545 A1 Jan. 14, 2016

(30) Foreign Application Priority Data

Jul. 8, 2014 (JP) ..... 2014-140673

(51) Int. Cl.

*G03G 15/20* (2006.01)
*G03G 15/00* (2006.01)
*G03G 15/23* (2006.01)

(52) U.S. Cl.

CPC ..... *G03G 15/235* (2013.01); *G03G 15/20* (2013.01); *G03G 15/205* (2013.01); *G03G 15/2017* (2013.01); *G03G 15/6585* (2013.01); *G03G 2215/0081* (2013.01); *G03G 2215/2083* (2013.01)

(58) Field of Classification Search

CPC ..... G03G 15/2028; G03G 15/6585; G03G 15/231; G03G 15/238; G03G 15/235

USPC ..... 399/67, 68, 320, 328, 400, 401; 219/216

See application file for complete search history.

(56) References Cited

U.S. PATENT DOCUMENTS

| | | | | |
|---|---|---|---|---|
| 5,910,388 | A * | 6/1999 | Ray | G03G 9/08 430/108.1 |
| 7,912,392 | B2 * | 3/2011 | Yoshinaga et al. | 399/69 |
| 8,983,324 | B2 * | 3/2015 | Kiuchi | 399/68 |
| 9,042,758 | B2 * | 5/2015 | Kubo et al. | 399/67 |
| 2004/0037573 | A1 * | 2/2004 | Hirota | G03G 15/0121 399/12 |
| 2011/0262858 | A1 * | 10/2011 | Nair | G03G 9/0804 430/110.2 |
| 2014/0029966 | A1 * | 1/2014 | Kojiri | 399/67 |
| 2014/0356008 | A1 * | 12/2014 | Harashima et al. | 399/69 |

(Continued)

FOREIGN PATENT DOCUMENTS

| | | | |
|---|---|---|---|
| JP | 62067558 | A * | 3/1987 |
| JP | 2003029484 | A * | 1/2003 |

(Continued)

*Primary Examiner* — Robert Beatty
(74) *Attorney, Agent, or Firm* — Oliff PLC

(57) ABSTRACT

An image forming apparatus includes an image forming unit, a heating unit, and a fixing unit. The image forming unit uses a toner including a flat pigment. The heating unit heats a recording medium. The fixing unit allows the recording medium to pass therethrough so as to cause an image formed on the recording medium to be fixed onto the recording medium by heat. In the image forming apparatus, the heating unit heats the recording medium on which the image has not been formed, the image forming unit forms the image on the recording medium having been heated, and the fixing unit fixes the image having been formed onto the recording medium.

8 Claims, 12 Drawing Sheets

(56) References Cited

U.S. PATENT DOCUMENTS

2014/0356035 A1* 12/2014 Harashima et al. ..... 399/321
2015/0160594 A1* 6/2015 Shibuya
2015/0168882 A1* 6/2015 Kakishima et al.
2015/0168883 A1* 6/2015 Kakishima et al.
2015/0168884 A1* 6/2015 Kakishima et al.

FOREIGN PATENT DOCUMENTS

JP 2004-029194 A 1/2004
JP 2006317632 A * 11/2006

* cited by examiner

IMAGE FORMING APPARATUS UTILIZING FLAT PIGMENT

CROSS-REFERENCE TO RELATED APPLICATIONS

This application is based on and claims priority under 35 USC 119 from Japanese Patent Application No. 2014-140673 filed Jul. 8, 2014.

BACKGROUND

Technical Field

The present invention relates to an image forming apparatus.

SUMMARY

An image forming apparatus according to an aspect of the present invention includes an image forming unit, a heating unit, and a fixing unit. The image forming unit uses a toner including a flat pigment. The heating unit heats a recording medium. The fixing unit allows the recording medium to pass therethrough so as to cause an image formed on the recording medium to be fixed onto the recording medium by heat. In the image forming apparatus, the heating unit heats the recording medium on which the image has not been formed, the image forming unit forms the image on the recording medium having been heated, and the fixing unit fixes the image having been formed onto the recording medium.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
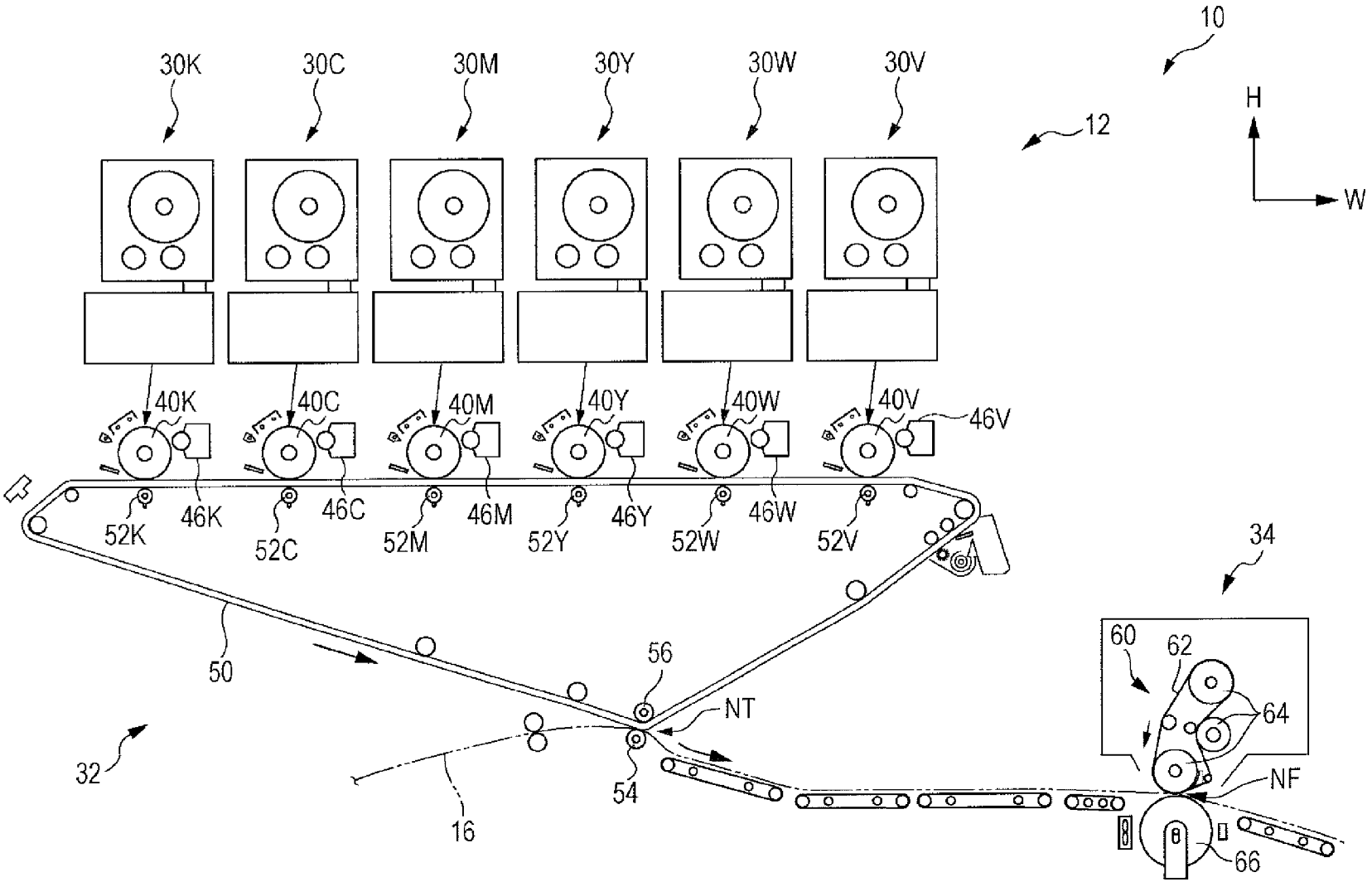
FIG. 1 is a view illustrating a structure of an image forming section of an image forming apparatus according to a first exemplary embodiment of the present invention.

An example of an image forming apparatus according to a first exemplary embodiment of the present invention will be described below with reference to FIGS. 1 to 11. In the drawings, an arrow H indicates the vertical direction, which is an up-down direction of the apparatus, and an arrow W indicates the horizontal direction, which is a width direction of the apparatus.

Overall Structure of the Image Forming Apparatus

Figure 11:
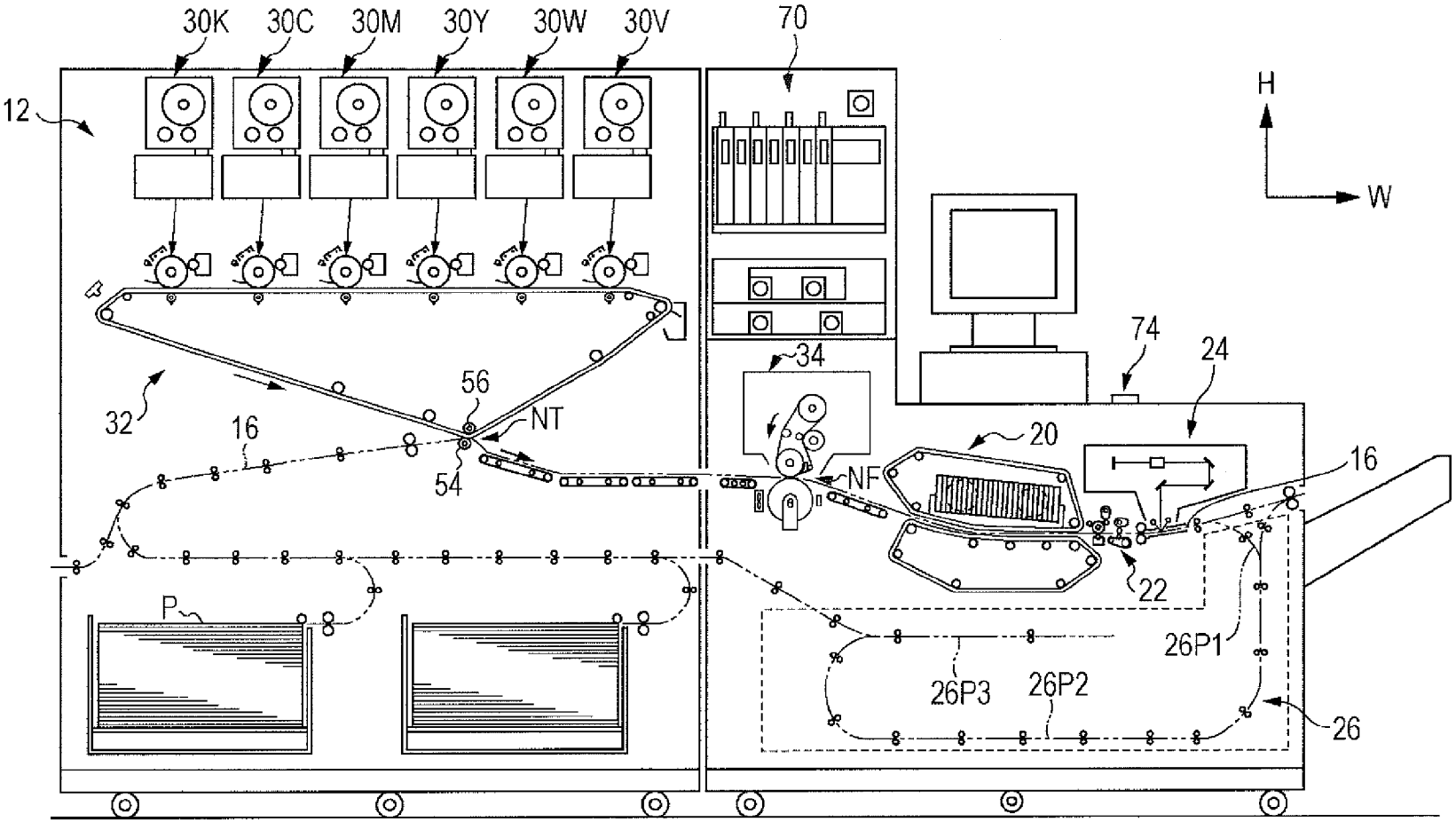
FIG. 11 is a view schematically illustrating a structure of the image forming apparatus according to the first exemplary embodiment of the present invention.

As illustrated in FIG. 11, an image forming apparatus 10 includes an image forming section 12 and plural transport members (not denoted by reference signs). The image forming section 12 forms an image with an electrophotographic method. The transport members transport a sheet member P (an example of a recording medium) on which an image or images are formed along a transport path 16 of a sheet member P.

The image forming apparatus 10 also includes a cooling unit 20, a correction unit 22, and an image inspection unit 24. The cooling unit 20 cools the sheet member P on which an image or images have been formed. The correction unit 22 corrects bending of the sheet member P. The image inspection unit 24 inspects the image or the images formed on the sheet member P.

Furthermore, the image forming apparatus 10 includes an inversion path 26. The sheet member P having an image formed on a front side thereof is inverted and transported to the image forming section 12 again through the inversion path 26 for image formation on both the sides of the sheet member P (duplex printing). Furthermore, the image forming apparatus 10 includes a controller 70 that controls components of the image forming apparatus 10.

With the image forming apparatus 10 having the above-described structure, toner images formed by the image forming section 12 are formed on the front side of the sheet member P being transported along the transport path 16. Furthermore, the sheet member P having the toner images formed thereon sequentially passes through the cooling unit 20, the correction unit 22, and the image inspection unit 24 in this order and is ejected to the outside of the apparatus.

When an image is formed on a back side of the sheet member P, the sheet member P having the image formed on the front side thereof is transported along the inversion path 26 so that an image is formed again on the back side of the sheet member P by the image forming section 12.

Image Forming Section

As illustrated in FIG. 1, the image forming section 12 includes plural toner image forming units 30 and a transfer unit 32. The toner image forming units 30 each form a toner image of a corresponding one of colors. The transfer unit 32 transfers the toner images formed by the toner image forming units 30 onto the sheet member P. The image forming section 12 also includes a fixing unit 34. The fixing unit 34 fixes onto the sheet member P the toner images which have been transferred onto the sheet member P by the transfer unit 32.

Toner Image Forming Units

The plural toner image forming units 30 are provided so that each of the toner image forming units 30 forms a toner image of a corresponding one of colors. In the present exemplary embodiment, the toner image forming units 30 of the following six colors are provided: a first special color (V), a second special color (W), yellow (Y), magenta (M), cyan (C), and black (K). Signs "V", "W", "Y", "M", "C", and "K" illustrated in, for example, FIG. 1 represent the above-described colors. The first special color (V) is silver. A toner of the first special color (v) includes pigment particles having a flat shape (flat pigment particles) so as to add metallic luster to an image. The second special color (W) is a user-specific corporate color used more frequently than the other colors. The details of the silver toner and control and the like of the components of the image forming apparatus 10 by the controller 70 when an image is formed with the silver toner will be described later.

In the following description, when it is not necessary that the first special color (V), the second special color (W), yellow (Y), magenta (M), cyan (C), and black (K) be distinguished from one another, V, W, Y, M, C, and K are not included in the signs hereafter.

Figure 10:
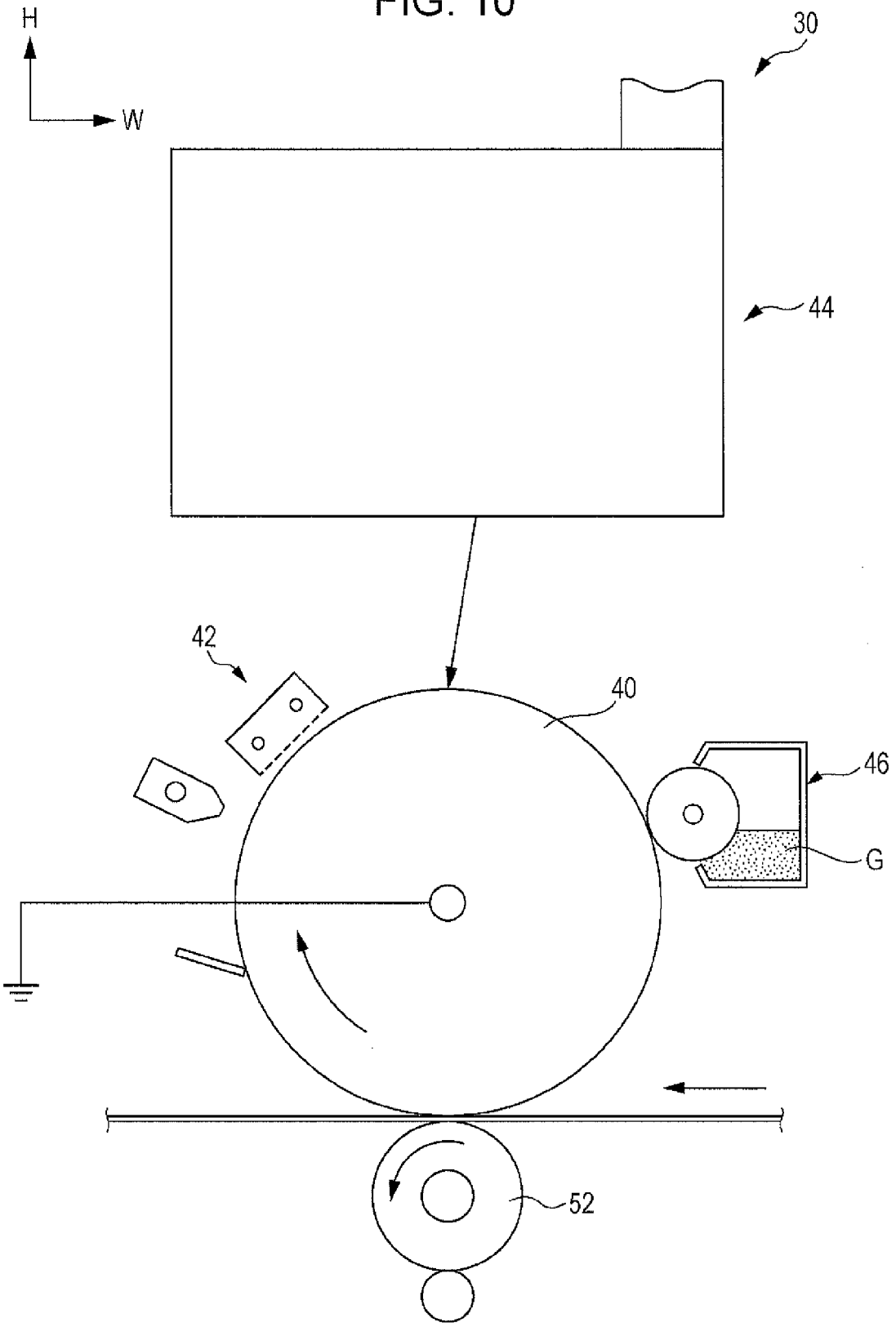
FIG. 10 is a view illustrating a structure of one of toner image forming units of the image forming apparatus according to the first exemplary embodiment of the present invention.

The toner image forming units 30 of the respective colors basically have structures similar to or the same as one another except for the toners used therein. The toner image forming units 30 each include, as illustrated in FIG. 10, a cylindrical image holding member 40 that is rotated and a charger 42 that charges the image holding member 40. Furthermore, each of the toner image forming units 30 includes an exposure device 44 and a developing device 46. The exposure device 44 radiates exposure light toward the charged image holding member 40 so as to form an electrostatic latent image. The developing device 46 develops the electrostatic latent image into a toner image with developer G containing a toner.

As illustrated in FIG. 1, the image holding members 40 of the respective colors are in contact with a transfer belt 50 that is moved in a circumferential path (the details of the transfer belt 50 will be described later). The toner image forming units 30 of the first special color (V), the second special color (W), yellow (Y), magenta (M), cyan (C), and black (K) are horizontally arranged side by side in this order from an upstream side in a circumferential direction (see an arrow in FIG. 1) of the transfer belt 50. The toner image forming units 30 of the colors each use a toner of a corresponding one of the colors to form an image of the corresponding color.

Transfer Unit

As illustrated in FIG. 1, the transfer unit 32 includes the transfer belt 50 and first transfer rollers 52. The transfer belt 50 is looped over plural rollers (not denoted by reference signs) and rotated in the arrow direction illustrated in FIG. 1. The first transfer rollers 52 are each provided for a corresponding one of the colors and transfer a toner image formed on the image holding member 40 of the corresponding color onto the transfer belt 50.

Each of the first transfer rollers 52 is disposed on a side opposite to a corresponding one of the image holding members 40 with the transfer belt 50 interposed therebetween. A transfer bias voltage (positive voltage), the polarity of which is opposite a toner polarity (negative polarity as an example in the present exemplary embodiment), is applied to the first transfer roller 52 by a power supply unit (not illustrated). By applying this transfer bias voltage, a transfer current is caused to flow between the first transfer roller 52 and the image holding member 40, thereby the toner image formed on the image holding member 40 is transferred onto the transfer belt 50.

The transfer unit 32 also includes a roller 56 and a second transfer roller 54. The transfer belt 50 is looped over the roller 56. The second transfer roller 54 is disposed on a side of the transfer belt 50 opposite to the roller 56 and causes the toner images having been transferred onto the transfer belt 50 to be transferred onto the sheet member P. Thus, a transfer nip NT that causes the toner images to be transferred onto the sheet member P is formed between the second transfer roller 54 and the transfer belt 50.

The transfer bias voltage (positive voltage), the polarity of which is opposite the toner polarity, is applied to the second transfer roller 54 by the power supply unit (not illustrated). The transfer current is caused to flow between the second transfer roller 54 and the roller 56 by applying the transfer bias voltage. This causes the toner images to be transferred (formed) from the transfer belt 50 to the sheet member P passing through the transfer nip NT.

With the above-described structure, the toner images of the first special color (V), the second special color (W), yellow (Y), magenta (M), cyan (C), and black (K) are sequentially transferred in this order onto the transfer belt 50 by the first transfer rollers 52 through first transfer such that these toner images are superposed on one another. Furthermore, these superposed toner images are transferred onto the sheet member P passing through the transfer nip NT by the second transfer roller 54 through second transfer.

Fixing Unit

Figure 9:
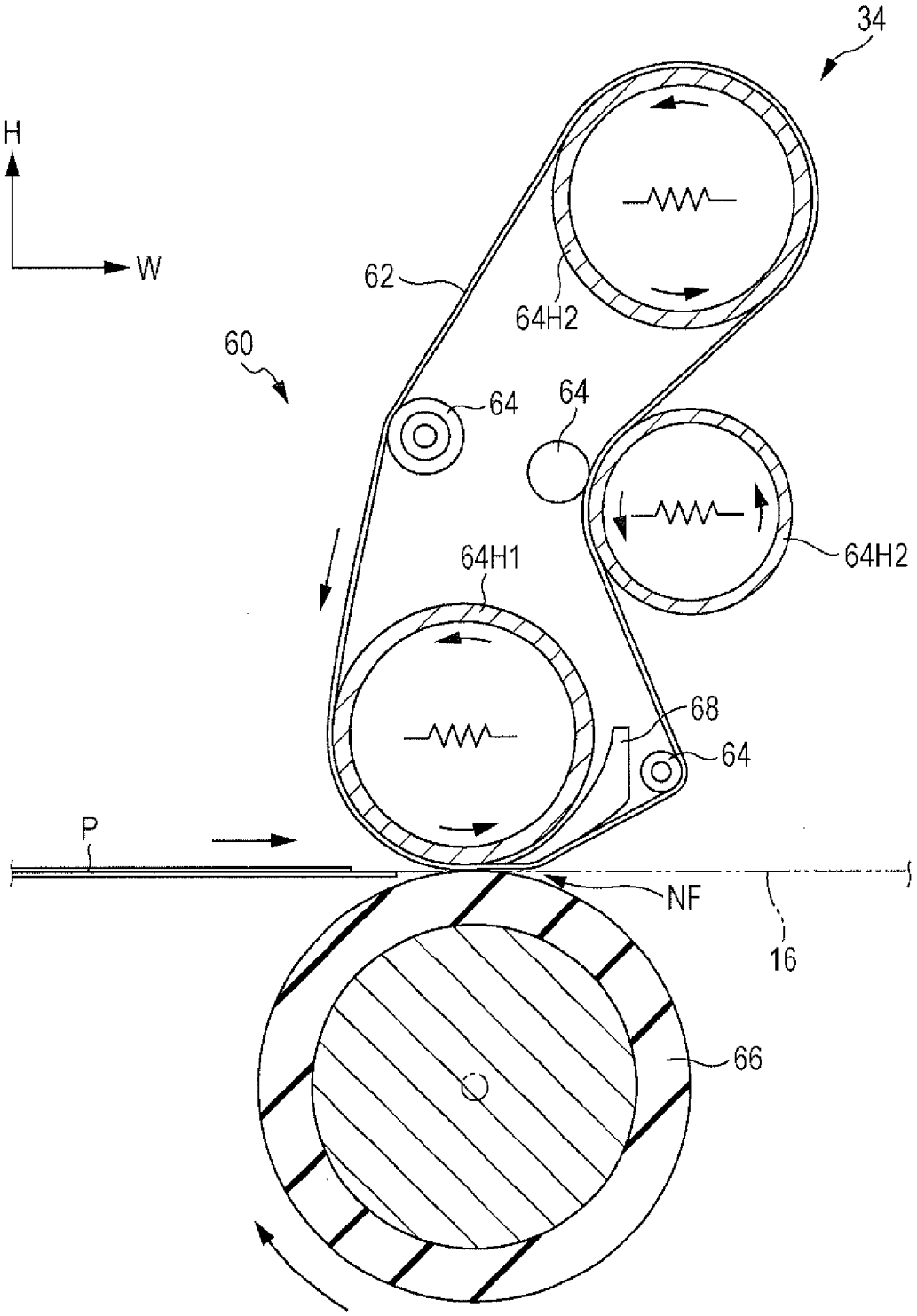
FIG. 9 is a view illustrating a structure of a fixing unit of the image forming apparatus according to the first exemplary embodiment of the present invention.

As illustrated in FIG. 9, the fixing unit 34 includes a fixing module 60 and a pressure roller 66. The fixing module 60 includes an endless fixing belt 62. The pressure roller 66 is in contact with the fixing module 60 so as to apply pressure to the fixing module 60. Furthermore, a fixing nip NF, at which the fixing belt 62 and the pressure roller 66 are in contact with each other, is formed between the fixing belt 62 and the pressure roller 66.

The fixing module 60 includes the endless fixing belt 62, plural rollers 64, and a separating pad 68. The plural rollers 64, over which the fixing belt 62 is looped, include a variety of sizes of rollers. The separating pad 68 is used to separate the sheet member P from the fixing belt 62. Out of the plural rollers 64, a roller 64H1, which is disposed on a side opposite to the pressure roller 66 with the fixing belt 62 interposed therebetween, includes a heat generating member therein and is subjected to a rotational force transmitted thereto so as to be rotated in an arrow direction illustrated in FIG. 9. Out of the plural rollers 64, a roller 64H2 also includes a heat generating member therein.

The pressure roller 66 is rotated at a circumferential speed substantially equal to the circumferential speed of the fixing belt 62 in the arrow direction illustrated in FIG. 9 by the rotational force transmitted thereto.

Inversion Path

As illustrated in FIG. 11, the sheet member P having passed through the image inspection unit 24 is fed to the inversion path 26. The inversion path 26 has a branch path 26P1, a transport subpath 26P2, and an inversion subpath 26P3.

The branch path 26P1 branches off from the transport path 16. The sheet member P transported from the branch path 26P1 is fed to part of the transport path 16 upstream of the transfer nip NT in a transport direction of the sheet member P through the transport subpath 26P2. The inversion subpath 26P3 is provided in the middle of the transport subpath 26P2. The sheet member P is inverted by reversing the transport direction of the sheet member P being transported through the transport subpath 26P2 (switchback transport). Plural transport members (not denoted by reference signs) are disposed along the inversion path 26 so as to transport the sheet member P.

Here, simplex printing and duplex printing are used for image formation performed on the sheet member P. An image is formed on one of the sides (for example, front side) of the sheet member P by simplex printing. Images are formed on one and the other sides (for example, front and back sides) of the sheet member P by duplex printing. In the case of duplex printing, the sheet member P having an image formed on the front side is transported along the inversion path 26 so as to be inverted, and transported to the image forming section 12 again.

Configuration of the Elements

Next, the silver toner used for the first special color (V), control performed by the controller 70 when an image is formed of the silver toner, a selecting member 74 with which image output modes for outputting an image are selectable, and the like are described.

Toner

As illustrated in FIG. 63, the silver toner used for the first special color (V) includes pigment particles 110 each serving as an example of a flat pigment and binder resin 111. The silver toner is used when giving a metallically glossy appearance to images. The images to which the metallically glossy appearance is given include images formed only of the silver toner and images formed of the silver toner and toners other than the silver toner.

The pigment particles 110 are made of aluminum. As illustrated in FIG. 4B, when one of the pigment particles 110 is placed on a flat surface and seen from a side, the dimensions of the pigment particle 110 are long in the horizontal direction than in the vertical direction of the page of FIG. 4B.

Figure 4A:
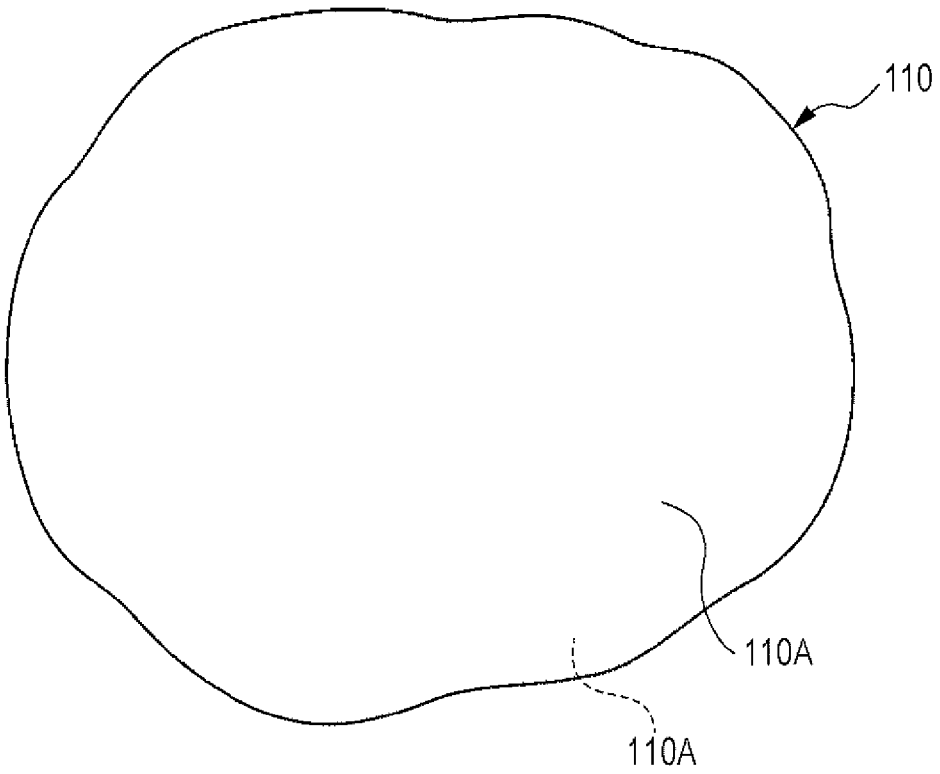
FIGS. 4A and 4B are respectively a plan view and a side view illustrating one of flat pigment particles included in toner used in the image forming apparatus according to the first exemplary embodiment of the present invention.
Figure 4B:
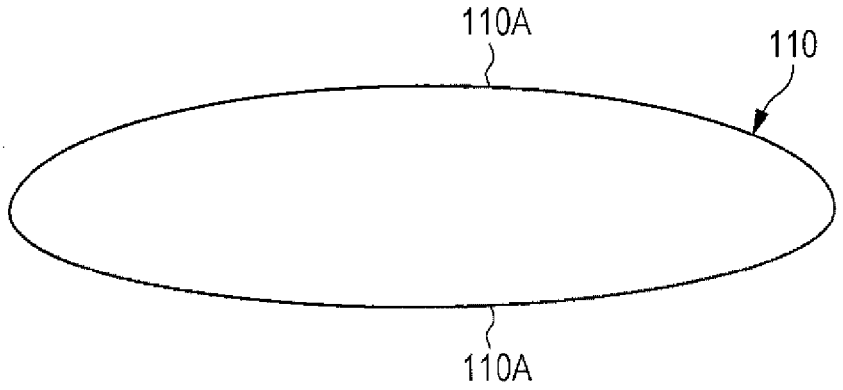

Furthermore, when the pigment particle 110 illustrated in FIG. 43 is seen from above in FIG. 43, the shape of the pigment particle 110 is enlarged compared to that seen from the side as illustrated in FIG. 4A. Furthermore, in the state in which the pigment particle 110 is placed on the flat surface (see FIG. 4B), the pigment particle 110 has a pair of reflective surfaces 110A (flat surfaces). One and the other of the pair of reflective surfaces 110A respectively face upward and downward. As has been described, the pigment particles 110 have a flat shape.

The toners of the colors other than silver (simply referred to as "toners of the other colors" hereafter), that is, the toners of the second special color (W), yellow (Y), magenta (M), cyan (C), and black (K) include binder resin and pigment particles (such as organic pigment particles and inorganic pigment particles) that do not include flat pigment particles.

Selecting Member

The image forming apparatus 10 is provided with the image output modes as follows: a first mode, in which the image quality of an image formed on the sheet member P is improved even when the improvement of the image quality leads to reduction of productivity (the number of sheets output per unit time); and a second mode, in which the productivity is improved even when the improvement of the productivity leads to degradation of the image quality of an image formed on the sheet member P. The image forming apparatus 10 includes the selecting member 74 (see FIG. 11) that allows a user to select the image output mode from the first mode and the second mode.

The details of the first mode and the second mode will be described along with operations of the elements that will be described later.

Controller

In response to an image forming instruction instructing that the metallically glossy appearance is given to at least part of an image, the controller 70 causes the toner image forming unit 30V for the silver toner (serving as an example of a first image forming unit) to be operated along with the toner image forming units 30 for the toners of the other colors (each serving as an example of a second image forming unit) or only the toner image forming unit 30V for the silver toner to be operated.

In contrast, in response to an image forming instruction instructing that the metallically glossy appearance is not given to an image, the controller 70 causes only the toner image forming units 30 for the toners of the other colors, which are different from the toner image forming unit 30V for the silver toner, to be operated.

The other configuration of the controller 70 will be described along with operations of the elements that will be described later.

Operations of the Elements

Next, control performed by the controller 70 to form on the sheet member P toner images to at least part of which the metallically glossy appearance is given ("glossy image" hereafter, may be described in the plural form, "glossy images" in the case, for example, where both the sides of the sheet member P have the same glossy image or different glossy images) is described with reference to flowcharts illustrated in FIGS. 2 and 3.

Figure 2:
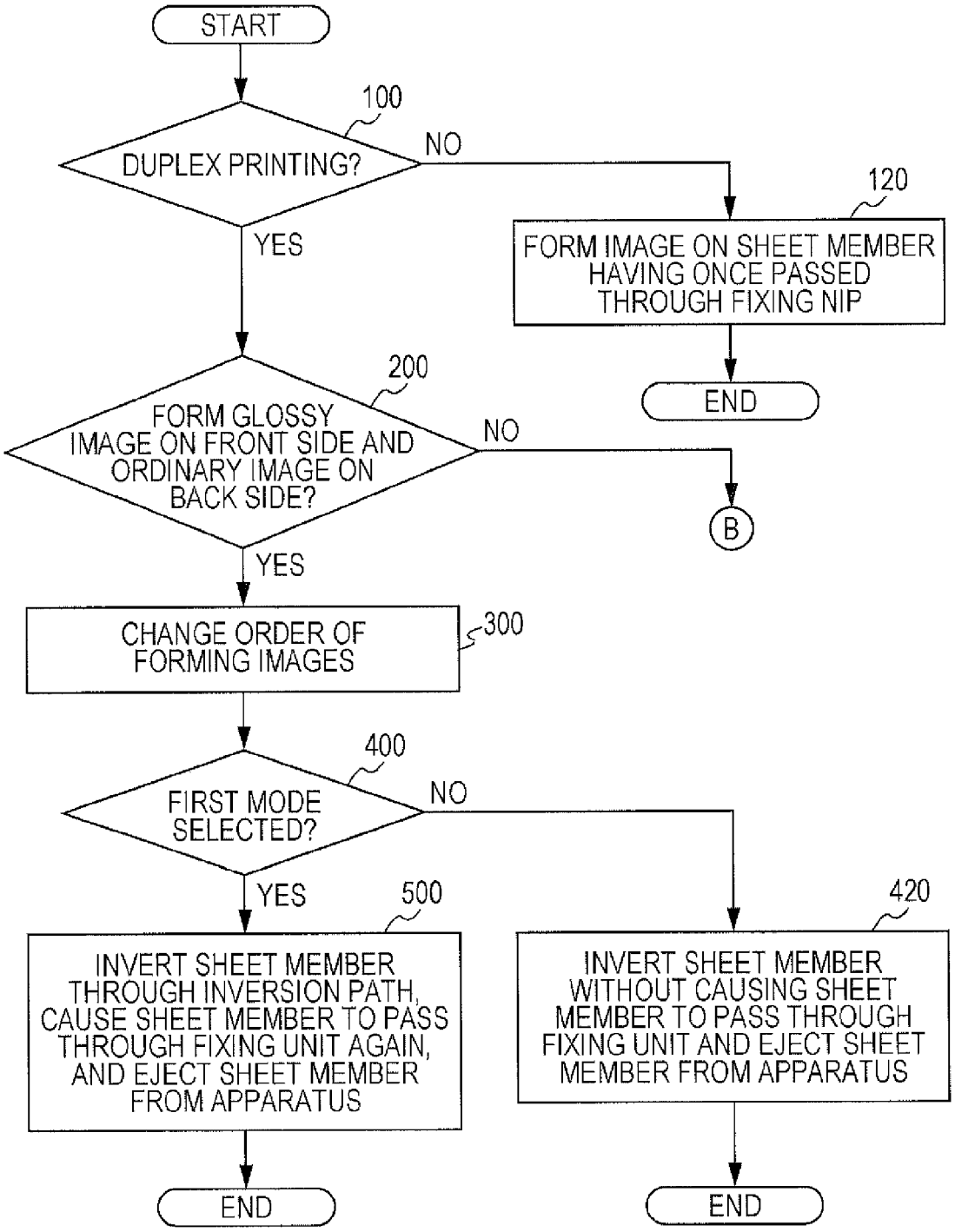
FIG. 2 is a flowchart illustrating steps when a glossy image or glossy images are formed on a sheet member with the image forming apparatus according to the first exemplary embodiment of the present invention.

Upon reception of the image forming instruction instructing that the metallically glossy appearance is given to at least part of an image, the controller 70 determines in step 100 whether or not duplex printing is performed (see FIG. 2).

In the case of duplex printing, processing advances to step 200. In the case of not duplex printing but simplex printing, the processing advances to step 120.

Next, in step 200, the controller 70 determines whether or not the image forming instruction instructs formation of the glossy image on the front side of the sheet member P and formation of an image to which the metallically glossy appearance is not given ("ordinary image" hereafter) on the back side of the sheet member P. In the case where the formation of the glossy image on the front side and the formation of the ordinary image on the back side are instructed, the processing advances to step 300. Otherwise, the processing advances to step 220 (see FIG. 3).

In step 300, the order in which the glossy image is first formed and the ordinary image is subsequently formed is changed by the image forming section 12.

Specifically, the toner image forming units 30W, 30Y, 30M, 30C, and 30K are initially operated. Images formed by the toner image forming units 30W, 30Y, 30M, 30C, and 30K are subsequently transferred onto the transfer belt 50 that is being rotated.

The ordinary image is formed on the transfer belt 50 from the images sequentially transferred onto the transfer belt 50 so as to be superposed on one another on the transfer belt 50. This ordinary image is transferred from the transfer belt 50 onto the front side of the sheet member P at the transfer nip NT (see FIG. 11).

The sheet member P having the ordinary image transferred onto the front side thereof is transported from the transfer nip NT to the fixing nip NF of the fixing unit 34. The fixing unit 34 applies heat and pressure to the sheet member P passing through the fixing nip NF. Thus, the ordinary image having been transferred onto the front side of the sheet member P is fixed onto the sheet member P.

Furthermore, the sheet member P having the ordinary image fixed onto the front side thereof passes through the cooling unit 20, the correction unit 22, and the image inspection unit 24. The sheet member P is further transported along the inversion path 26 so as to be inverted and transported to the transfer nip NT again.

Meanwhile, the toner image forming units 30V, 30W, 30Y, 30M, 30C, and 30K are operated in the image forming section 12. Images formed by the toner image forming units 30V, 30W, 30Y, 30M, 30C, and 30K are sequentially transferred onto the transfer belt 50 that is being rotated. The glossy image is formed on the transfer belt 50 from the images sequentially transferred onto the transfer belt 50 so as to be superposed on one another on the transfer belt 50.

This glossy image is transferred at the transfer nip NT onto the back side of the sheet member P having the ordinary image fixed on its front side.

The sheet member P having the glossy image transferred onto the back side thereof is transported from the transfer nip NT to the fixing nip NF of the fixing unit 34. The fixing unit 34 applies heat and pressure to the sheet member P passing through the fixing nip NF. Thus, the glossy image having been transferred onto the back side of the sheet member P is fixed onto the sheet member P.

The order of forming the images is changed by the image forming section 12 as described above, the images are formed on the front side and the back side of the sheet member P, and after that, the processing advances to step 400 (see FIG. 2).

In step 400, the controller 70 determines whether or not the first mode is selected with the selecting member 74. If the first mode is selected, the processing advances to step 500. Otherwise, the processing advances to step 420.

In step 500, the sheet member P having the images on the front and back sides thereof is transported along the inversion path 26 again. The sheet member P is inverted by the inversion path 26 and transported to the transfer nip NT. The sheet member P passes through the transfer nip NT while no image is transferred onto the sheet member P. The sheet member P having passed through the transfer nip NT is transported to the fixing nip NF of the fixing unit 34. The sheet member P is subjected to heat and pressure while passing through the fixing nip NF again, and after that, ejected to the outside of an apparatus body through the cooling unit 20, the correction unit 22, and the image inspection unit 24. Thus, the image forming steps are completed.

As described above, the processing advances to step 420 if the first mode is not selected.

Figure 8A:
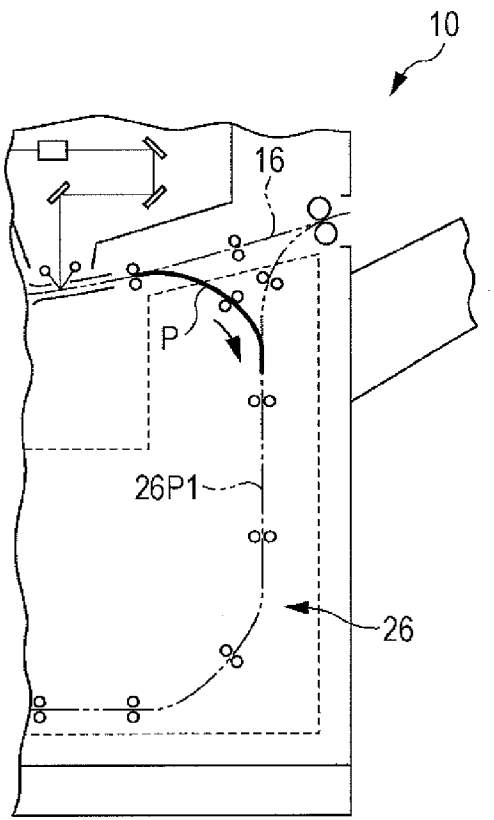
FIGS. 8A, 8B, and 8C illustrate transport steps of inverting the sheet member in the image forming apparatus according to the first exemplary embodiment of the present invention.
Figure 8B:
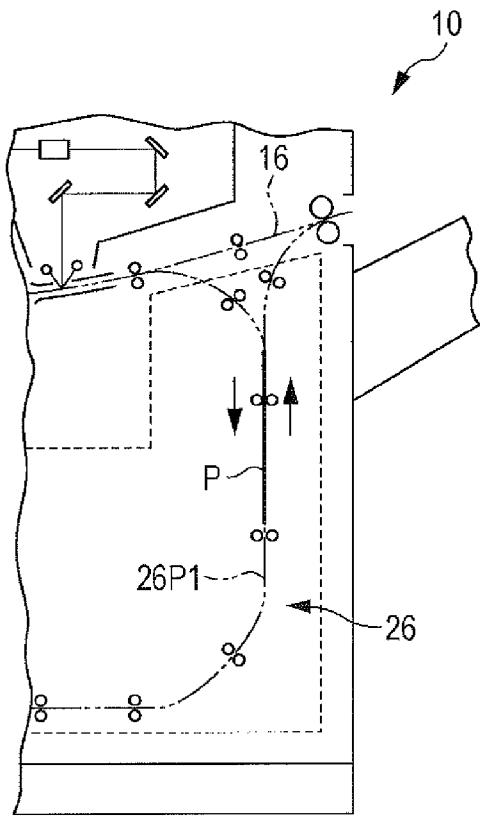
Figure 8C:
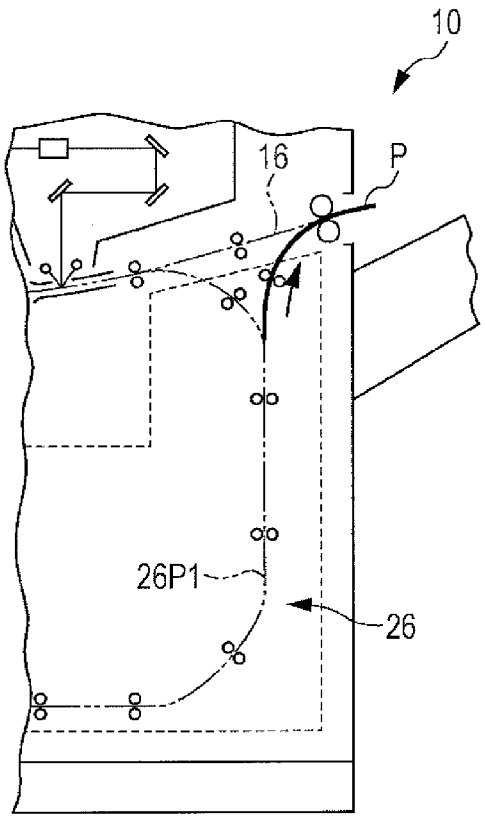

In step 420, the sheet member P having the images formed on the front and back sides thereof is once drawn into the inversion path 26 so as to perform switchback of the sheet member P as illustrated in FIGS. 8A to 8C. This causes the sheet member P to be inverted and ejected to the outside of the apparatus body. Thus, the image forming steps are completed. That is, compared to the case where the sheet member P passes through the fixing nip NF, the sheet member P is inverted and ejected to the outside of the apparatus body through a reduced transport distance. Thus, the image forming steps are completed.

In contrast, if the controller 70 determines that simplex printing is performed in step 100, the processing advances to step 120 as described above (see FIG. 2).

In step 120, the controller 70 causes the glossy image to be formed on the sheet member P having once passed through the fixing nip NF.

Specifically, the sheet member P is initially transported to the transfer nip NT. The sheet member P passes through the transfer nip NT while no image is transferred onto the sheet member P. The sheet member P having passed through the transfer nip NT is transported to the fixing nip NF of the fixing unit 34 (see FIG. 11). The sheet member P is heated while passing through the fixing nip NF. The sheet member P further passes through the cooling unit 20, the correction unit 22, and the image inspection unit 24, is transported along the inversion path 26 so as to be inverted, and transported to the transfer nip NT again.

In the image forming section 12, the toner image forming units 30V, 30W, 30Y, 30M, 30C, and 30K are operated. Images formed by the toner image forming units 30V, 30W, 30Y, 30M, 30C, and 30K are sequentially transferred onto the transfer belt 50 that is being rotated. The glossy image is formed on the transfer belt 50 from the images sequentially transferred onto the transfer belt 50 so as to be superposed on one another on the transfer belt 50.

This glossy image is transferred onto the sheet member P passing through the transfer nip NT.

The sheet member P having the glossy image transferred thereonto is transported to the fixing nip NF of the fixing unit 34. The fixing unit 34 applies heat and pressure to the sheet member P passing through the fixing nip NF. Thus, the glossy image having been transferred onto the sheet member P is fixed onto the sheet member P. Then, the sheet member P is ejected to the outside of the apparatus body through the cooling unit 20, the correction unit 22, and the image inspection unit 24. Thus, the image forming steps are completed.

Figure 3:
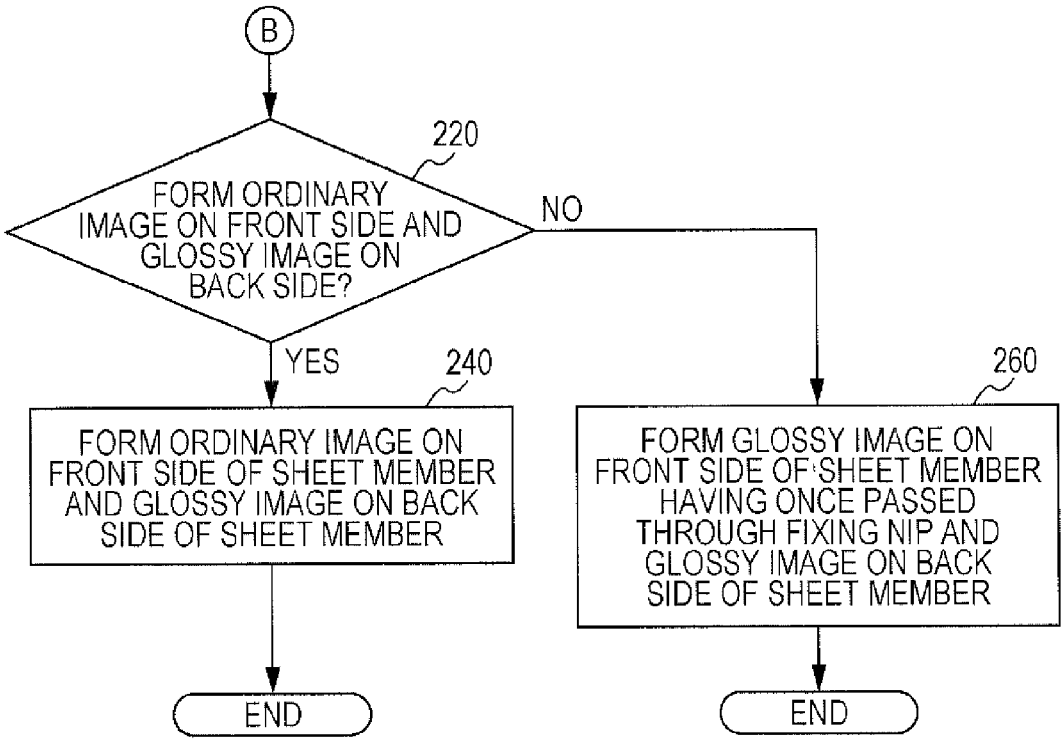
FIG. 3 is a flowchart illustrating steps when the glossy image or the glossy images are formed on a sheet member with the image forming apparatus according to the first exemplary embodiment of the present invention.

In contrast, as described above, if the image forming instruction is not an instruction that instructs the formation of the glossy image on the front side of the sheet member P and the formation of the ordinary image on the back side of the sheet member P, the processing advances to step 220 (see FIG. 3).

In step 220, the controller 70 determines whether or not the image forming instruction instructs the formation of the ordinary image on the front side of the sheet member P and the formation of the glossy image on the back side of the sheet member P. If the formation of the ordinary image on the front side and the formation of the glossy image on the back side are instructed, the processing advances to step 240. Otherwise (in the case of formation of the glossy images on both the front and back sides), the processing advances to step 260.

In step 240, the ordinary image is transferred onto the front side of the sheet member P and fixed onto the sheet member P without changing the order of forming the images by the image forming section 12. The sheet member P is further transported along the inversion path 26 so as to be inverted. The glossy image is transferred onto the back side of the inverted sheet member P, and the transferred image is fixed onto the sheet member P. The sheet member P having the images formed on both the front and back sides thereof is ejected to the outside of the apparatus body. Thus, the image forming steps are completed.

In step 260, the controller 70 causes the images to be formed on the sheet member P having once passed through the fixing nip NF.

Specifically, the sheet member P is initially transported to the transfer nip NT. The sheet member P passes through the transfer nip NT while no image is transferred onto the sheet member P. The sheet member P having passed through the transfer nip NT is transported to the fixing nip NF of the fixing unit 34 (see FIG. 11). The sheet member P is heated while passing through the fixing nip NF. The sheet member P further passes through the cooling unit 20, the correction unit 22, and the image inspection unit 24, is transported along the inversion path 26 so as to be inverted, and transported to the transfer nip NT again.

Without changing the order of forming the images by the image forming section 12, the glossy image is transferred onto the front side of this sheet member P transported to the transfer nip NT again, and the transferred image is fixed onto the sheet member P. The sheet member P is further transported along the inversion path 26 so as to be inverted. The glossy image is transferred onto the back side of the inverted sheet member P, and the transferred image is fixed onto the sheet member P. The sheet member P having the images formed on both the front and back sides thereof is ejected to the outside of the apparatus body. Thus, the image forming steps are completed.

Evaluation

Figure 7:
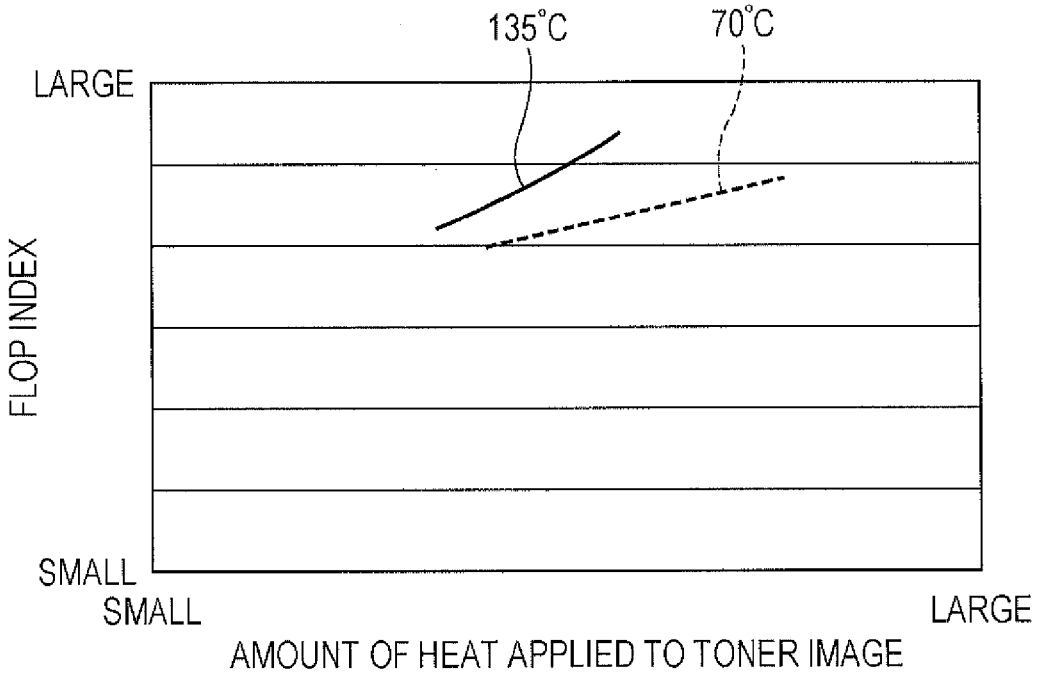
FIG. 7 is a graph illustrating the relationship between the flop index of a toner image formed by the image forming apparatus according to the first exemplary embodiment of the present invention and an amount of heat applied to the toner image.

Next, referring to FIG. 7, results of measurement of the flop index (FI) performed in accordance with American Society for Testing and Materials (ASTM) E2194 on an image formed of the silver toner on the sheet member P are described. The flop index represents the metallically glossy appearance. The flop index increases as the metallically glossy appearance is improved.

Evaluation Specifications

As the sheet member P, OS coat W (by Fuji Xerox InterField Co., Ltd., basic weight: 127 g/m$^2$, smoothness measured in accordance with Japanese Industrial Standard (JIS) P 8119 is 4735 sec) is used. Regarding the toner, only the silver toner is used. The surface temperature of the pressure roller 66 is set to 70° C. and 135° C., and the surface temperature of the fixing belt 62 is changed, thereby the amount of heat applied to toner images transferred onto the sheet member P is changed.

Evaluation Results

In a graph illustrated in FIG. 7, the vertical axis and the horizontal axis respectively represent the flop index and the heat amount applied by the fixing unit 34 to the toner image transferred onto the sheet member P.

In the graph, a broken line represents the relationship between the flop index and the heat amount applied to the toner image, the heat amount being changed by changing the surface temperature of the fixing belt 62, while the surface temperature of the pressure roller 66 is set to 70° C. Also in the graph, a solid line represents the relationship between the flop index and the heat amount applied to the toner image, the heat mount being changed by changing the surface temperature of the fixing belt 62, while the surface temperature of the pressure roller 66 is set to 135° C.

Brief Summarization of Evaluation

It is understood from this graph that, when the surface temperature of the pressure roller 66 is substantially the same, the flop index may be improved by increasing the heat amount applied to the toner image. In other words, it is understood that, by increasing the heat amount applied from the fixing belt 62 side to the toner image, the flop index may be improved.

Furthermore, it is understood that, when the heat amount applied to the toner image is substantially the same, the flop index may be improved by increasing the surface temperature of the pressure roller 66.

That is, it is understood that, when the heat amount applied to the toner image is substantially the same, the flop index may be effectively improved by increasing the heat amount applied to the toner image from a side of the sheet member P where no toner image is formed. That is, it is understood that the flop index may be more effectively improved in the case where the sheet member P is preheated than in the case where the sheet member P is not preheated.

The reason why the flop index may be improved by increasing the heat amount applied when fixing the toner image onto the sheet member P is as follows.

Figure 5A:
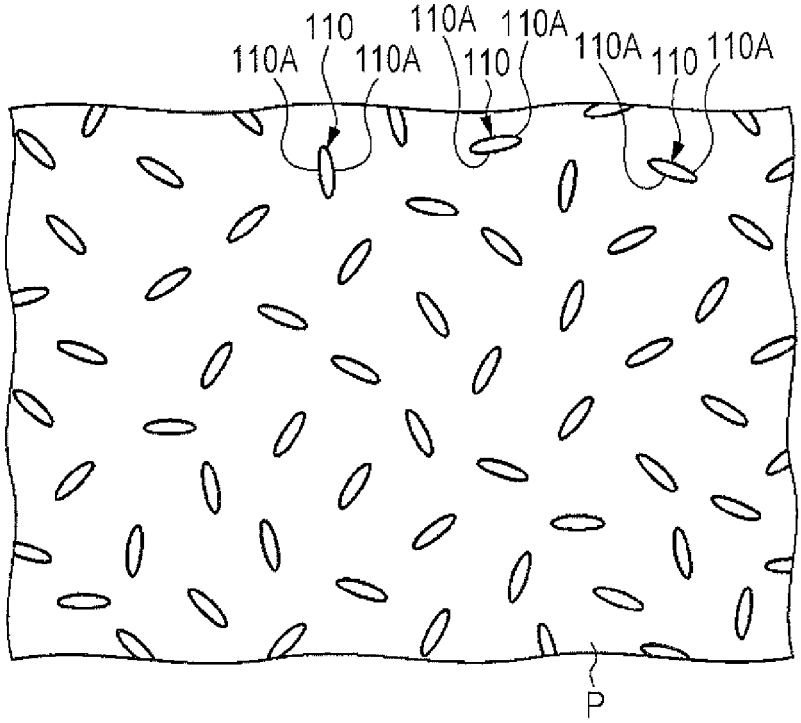
FIGS. 5A and 5B are plan views respectively illustrating a comparative example and positions of the flat pigment particles included in a toner image formed by the image forming apparatus according to the first exemplary embodiment of the present invention.
Figure 5B:
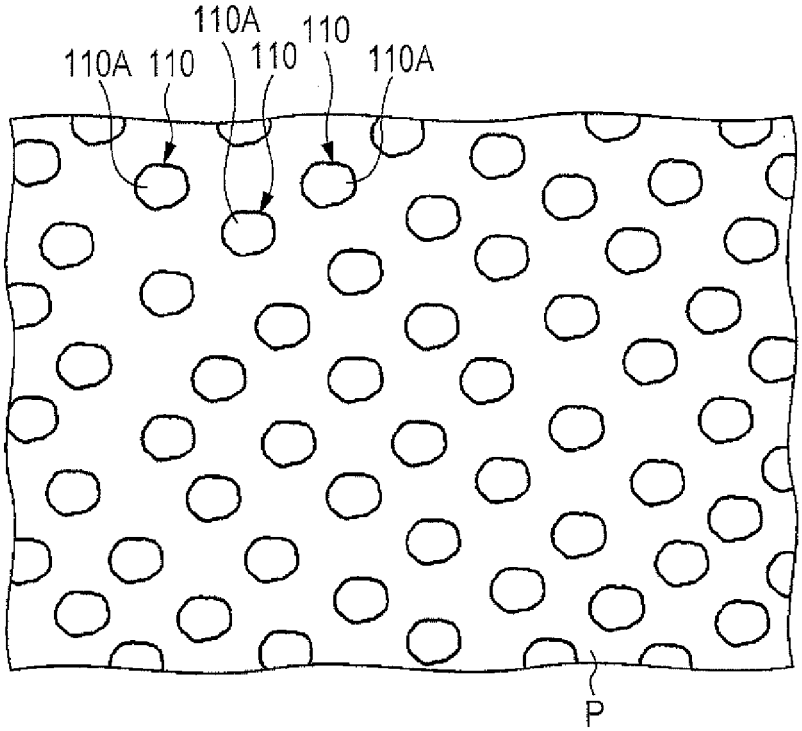

The resin binder included in the toner is softened by increasing the heat amount applied when fixing the toner image onto the sheet member P. This facilitates movements of the flat pigment particles 110 included in the toner. In this state, by causing the pressure roller 66 to apply pressure to the toner image in a direction toward the fixing belt 62, the reflective surfaces 110A of the pigment particles 110 face in a direction perpendicular to a sheet surface of the sheet member P (x direction in FIG. 6B) as illustrated in FIG. 6B. Furthermore, the pigment particles 110 are arranged in a direction along the sheet surface of the sheet member P (Y direction in FIG. 6B). As illustrated in FIG. 5B, the pigment particles 110 having the reflective surfaces 110A that face in the direction perpendicular to the sheet surface are evenly distributed on the sheet member P.

Figure 6A:
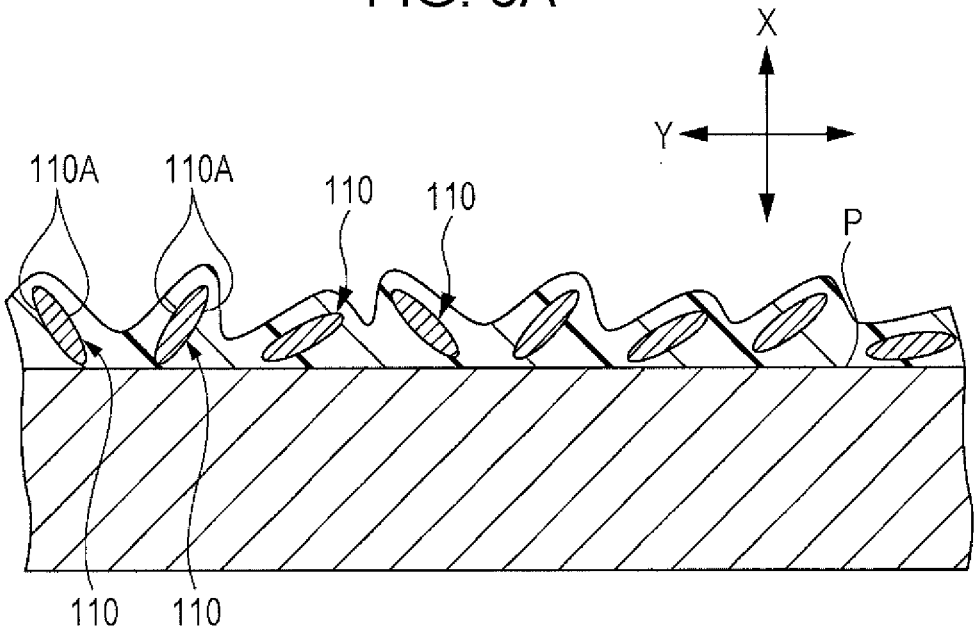
FIGS. 6A and 6B are sectional views respectively illustrating the comparative example and the positions of the flat pigment particles included in the toner image formed by the image forming apparatus according to the first exemplary embodiment of the present invention.
Figure 6B:
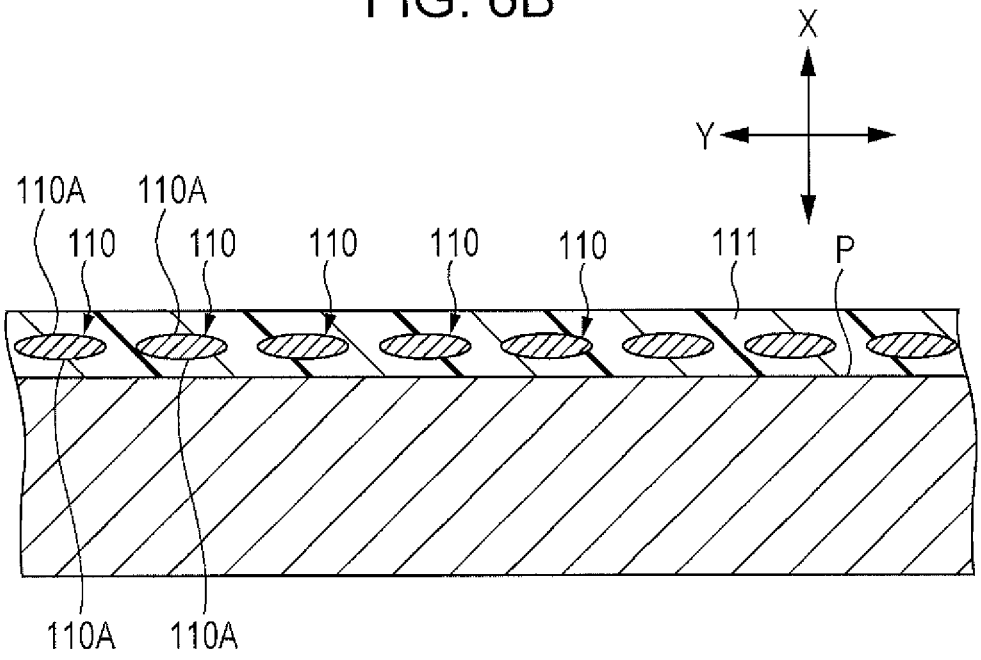

As illustrated in FIG. 6B, by arranging the pigment particles 110 in the direction along the sheet surface with the reflective surfaces 110A of the pigment particles 110 facing the direction perpendicular to the sheet surface, diffusion of light reflected from the image is reduced compared to the case where the reflective surfaces 110A of the pigment particles 110 face non-uniform directions as illustrated in FIG. 6A. Thus, the flop index may be improved.

Furthermore, as illustrated in FIG. 5B, the pigment particles 110 having the reflective surfaces 110A that face in the direction perpendicular to the sheet surface are evenly distributed on the sheet member P. Thus, a covering ratio, at which the sheet member P is covered by the pigment particles 110, is improved compared to the case illustrated in FIG. 5A where the pigment particles 110 having the reflective surfaces 110A that face in non-uniform directions are arranged on the sheet member P. In other words, a reflecting area, by which light incident upon the surface of the sheet member P is reflected by the pigment particles 110, is increased. This may also increase the flop index.

The reason why the flop index may be more effectively improved by heating the sheet member P side of the toner image than by heating a surface side (a side opposite to the sheet member P) of the toner image is described below.

As illustrated in FIG. 6B, the binder resin 111 also exists between the sheet member P and the pigment particles 110. The pigment particles 110 are pushed toward the sheet member P when the sheet member P is pinched between the fixing belt 62 and the pressure roller 66. In the case where the pigment particles 110 are pushed as described above, as the degree of softening of the binder resin 111 existing between the sheet member P and the pigment particles 110 increases, it may be more likely that the directions of the reflective surfaces 110A of the pigment particles 110 follow the direction of the sheet surface of the sheet member P than in the case where the degree of softening is small.

Furthermore, by applying heat to the toner image from the sheet member P side of the toner image, the degree of the softening of the binder resin 111 existing between the sheet member P and the pigment particles 110 increases. Thus, by increasing the heat amount applied to the toner image from the sheet member P side of the toner image, the flop index may be more effectively improved than by heating from the surface side of the toner image.

Summarization

As has been described, when the glossy image is formed on the front side of the sheet member P in simplex printing, the glossy image is formed in step 120 on the sheet member P having once passed through the fixing nip NF. Furthermore, when the glossy image is formed on the front side of the sheet member P and the ordinary image is formed on the back side of the sheet member P in duplex printing, the order of forming the images is changed in step 300. That is, the glossy image is formed on the back side of the sheet member P after the ordinary image has been formed on the front side of the sheet member P. Also in duplex printing, when the glossy images are formed on both the front and back sides of the sheet member P, one of the glossy images is formed on the front side of the sheet member P having once passed through the fixing nip NF, and then the other glossy image is formed on the back side of the sheet member P in step 260.

As described above, the glossy image is formed on the sheet member P heated by the fixing unit 34. Thus, it may be more likely that the pigment particles 110 assume positions in which the directions of the reflective surfaces 110A of the pigment particles 110 follow the direction of the sheet surface of the sheet member P than in the case where the glossy image is formed on the sheet member P that has not been heated.

Furthermore, since the reflective surfaces 110A may assume positions in which the directions of the reflective surfaces 110A follow the direction of the sheet surface of the sheet member P, the flop index may be improved compared to the case where the reflective surfaces 110A do not follow the direction of the sheet surface of the sheet member P.

Furthermore, heat is applied to the toner image from the sheet member P side of the toner image by heating the sheet member P. Thus, the flop index may be improved compared to the case where heat is applied to the toner image from the surface side of the toner image.

Furthermore, if the order of forming the images is changed in step 300 and the first mode is selected with the selecting member 74, the sheet member P having the images formed on the front and back sides thereof is transported along the inversion path 26 again in step 500. The sheet member P is inverted and ejected to the outside of the apparatus body through the transfer nip NT and the fixing nip NF. When the sheet member P is inverted as described above, the flop index may be improved (image quality may be improved) by causing the sheet member P to pass through the fixing nip NF compared to the case where the sheet member P does not pass through the fixing nip NF.

Furthermore, if the order of forming the images is changed in step 300 and the second mode is selected as the output mode with the selecting member 74, the sheet member P is inverted and ejected to the outside of the apparatus body through a reduced transport distance in step 420 compared to the case where the sheet member P passes through the fixing nip NF. Thus, compared to the case where the sheet member P is caused to pass through the fixing nip NF again after having been inverted, the productivity (the number of sheets output per unit time) may be improved.

Second Exemplary Embodiment

Next, an example of an image forming apparatus according to a second exemplary embodiment of the present invention will be described with reference to FIG. 12. The same elements as those in the first exemplary embodiment are denoted by the same reference signs and description thereof is omitted. The features of the second exemplary embodiment different from those of the first exemplary embodiment are described.

Figure 12:
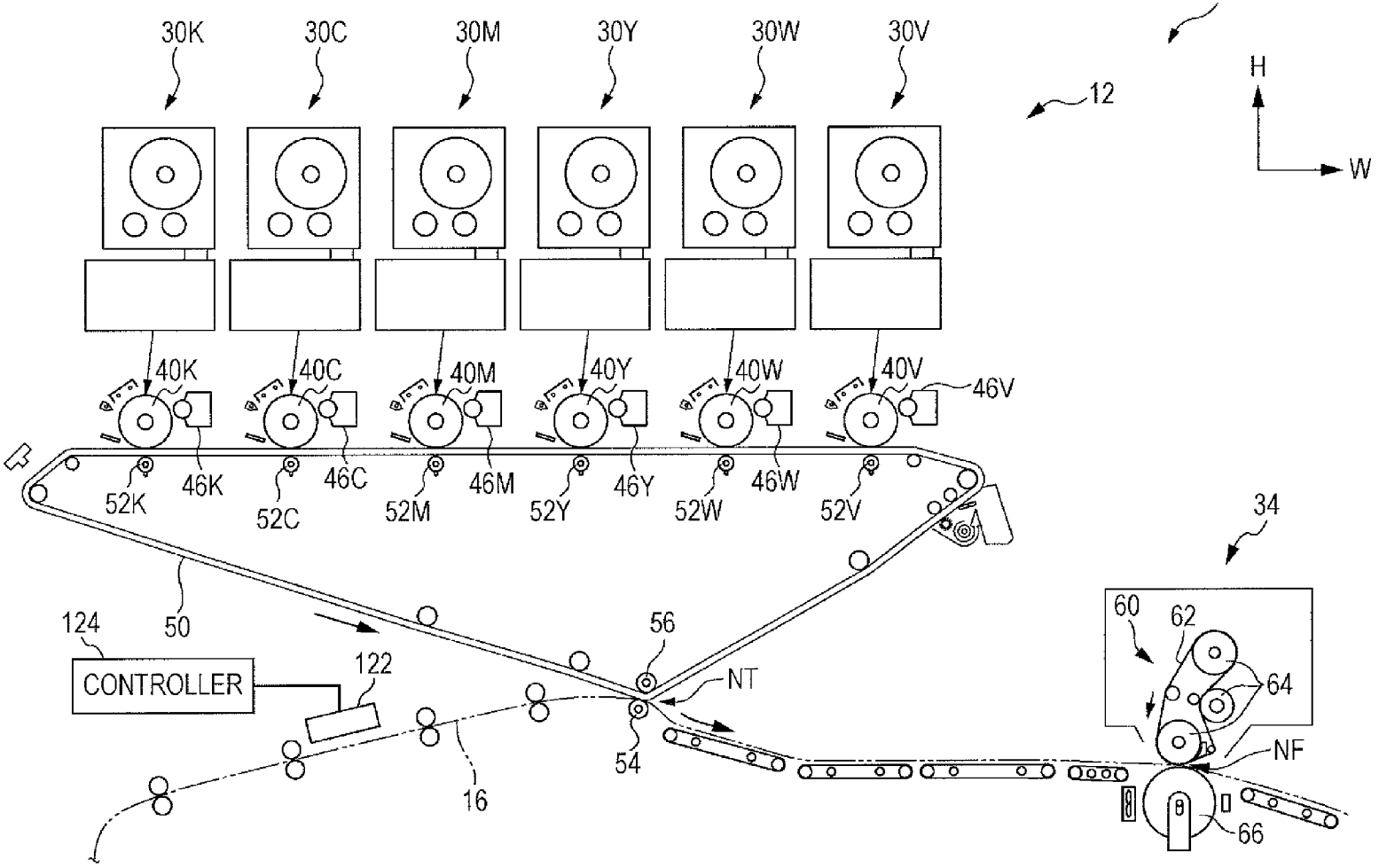
FIG. 12 is a view illustrating a structure of an image forming section of an image forming apparatus according to a second exemplary embodiment of the present invention.

As illustrated in FIG. 12, an image forming apparatus 120 according to the second exemplary embodiment includes a heater 122 (an example of a heating unit) and a controller 124. The heater 122 heats the sheet member P transported along the transport path 16. The controller 124 controls the components of the image forming apparatus 120. The heater 122 faces part of the transport path 16, the part being upstream of the transfer nip NT in the sheet member P transport direction.

In simplex printing, when the glossy image is formed on the front side of the sheet member P, the controller 124 causes the heater 122 to operate so that the glossy image is formed on the sheet member P having been heated by the heater 122. Thus, the controller 124 causes the glossy image to be formed on the sheet member P as described above instead of forming the glossy image on the sheet member P having once passed through the fixing nip NF.

Furthermore, in duplex printing, when the glossy images are formed on the front and back sides of the sheet member P, the controller 124 causes the heater 122 to operate so that the glossy image is formed on the front side of the sheet member P having been heated by the heater 122. Thus, the controller 124 causes the glossy image to be formed on the front side of the sheet member P as described above instead of forming the glossy image on the sheet member P having once passed through the fixing nip NF.

Furthermore, in duplex printing, when the glossy image and the ordinary image are respectively formed on the front side and the back side of the sheet member P, the controller 124 causes the heater 122 to operate so that the glossy image is formed on the front side of the sheet member P having been heated by the heater 122. Thus, the controller 124 causes the glossy image to be formed on the front side of the sheet member P without changing the order of forming the images so as to cause the glossy image to be formed on the sheet member P having once passed through the fixing nip NF.

As described above, the sheet member P is heated by the heater 122 without passing through the fixing nip NF. Thus, compared to the case where the sheet member P is caused to pass through the fixing nip NF, the transport distance of the sheet member P is reduced. This may improve the productivity.

Although the specific embodiments of the present invention have been described, the present invention is not limited to these embodiments. Obviously, those skilled in the art understand that various other embodiments are possible within the scope of the present invention. For example, although the first mode or the second mode is selected with the selecting member 74 in the above-described first exemplary embodiment, a mode or modes other than the first mode and the second mode may be provided. For example, a third mode may be provided, in which the productivity is prioritized more than in the second mode as follows: that is, in the third mode, the sheet member P on which the images have been formed on its front and back sides in step 300 may be ejected to the outside of the apparatus body without being inverted.

In the above-described exemplary embodiments, the first mode or the second mode is selected with the selecting member 74. Instead, the first mode or the second mode may be selected, for example, in accordance with instructions input from a screen of a user interface or in accordance with instruction from an external computer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that uses a toner including a flat pigment and a toner not including a flat pigment;

a heating unit that heats a recording medium; and a fixing unit that allows the recording medium to pass therethrough so as to cause an image formed on the recording medium to be fixed onto the recording medium by heat, wherein the heating unit heats the recording medium on which the image has not been formed, the image forming unit forms the image on the recording medium having been heated, and the fixing unit fixes the image having been formed onto the recording medium, wherein the image forming unit uses the toner including the flat pigment to form a first color and uses a toner not including the flat pigment to form a second color.

2. The image forming apparatus according to claim 1, wherein the toner including the at flat pigment comprises a binder and a flat pigment.

3. The image forming apparatus according to claim 1, wherein the image forming unit forms the image using the toner including the flat pigment after the heating unit heated the recording medium.

4. The image forming apparatus according to claim 1, wherein the flat pigment applies metallic luster to the image.

5. The image forming apparatus according to claim 1, wherein the flat pigment comprises a metal.

6. An image forming apparatus comprising:

an image forming unit that uses a toner including a flat pigment and a toner not including a flat pigment; and a fixing unit that allows a recording medium to pass therethrough so as to cause an image formed on the recording medium to be fixed onto the recording medium by heat, wherein the recording medium on which the image has not been formed passes through the fixing unit so as to be heated, the image forming unit forms an image on the recording medium having been heated, and the fixing unit fixes the image having been formed onto the recording medium, and wherein the image forming unit uses the toner including the flat pigment to form a first color and uses a toner not including the flat pigment to form a second color.

7. An image forming apparatus comprising:

a first image forming unit that uses a toner including a flat pigment;

a second image forming unit that uses a toner not including the flat pigment;

a fixing unit that allows a recording medium to pass therethrough so as to fix an image formed on the recording medium onto the recording medium by heat; and a controller, wherein the recording medium has a first side and a second side, and wherein in response to an instruction instructing that the first image forming unit forms a first image on the first side and then the second image forming unit forms a second image on the second side, an order of forming the first and second images is changed by the controller so that the second image forming unit forms the second image on the first side, the first image forming unit forms the first image on the second side after the formed second image has been fixed onto the recording medium by the fixing unit, and the first image having been formed is fixed onto the recording medium by the fixing unit.

8. The image forming apparatus according to claim 7 further comprising:

a first mode and a second mode, wherein, when the order of forming the first and second images is changed and the first mode is selected, the recording medium having the first and second images fixed thereon is inverted, caused to pass through the fixing unit again, and then ejected to an outside of the image forming apparatus, and wherein, when the order of forming the first and second images is changed and the second mode is selected, the recording medium having the first and second images fixed thereon is inverted and ejected to the outside of the image forming apparatus without passing through the fixing unit again.

* * * * *